United States Patent [19]

Warren et al.

[11] 4,174,814

[45] Nov. 20, 1979

[54] IMPELLER SHOE FOR CENTRIFUGAL IMPACT ROCK CRUSHING MACHINE

[75] Inventors: Kenneth D. Warren; Robert G. Tenold, both of Spokane, Wash.

[73] Assignee: Spokane Crusher Manufacturing Co., Spokane, Wash.

[21] Appl. No.: 892,886

[22] Filed: Apr. 3, 1978

[51] Int. Cl.[2] ..... B02C 13/18

[52] U.S. Cl. ..... 241/275; 51/435

[58] Field of Search ..... 51/434, 435; 241/275, 241/DIG. 10; 416/237

[56] References Cited

U.S. PATENT DOCUMENTS

| | | | |
|---|---|---|---|
| 3,000,579 | 9/1961 | Bridgewater | 241/275 |
| 3,606,182 | 9/1971 | Warren | 241/275 |
| 3,936,979 | 2/1976 | Fuerst | 241/275 X |

*Primary Examiner*—Mark Rosenbaum

*Attorney, Agent, or Firm*—Wells, St. John & Roberts

[57] ABSTRACT

An impeller shoe is described for mounting on the turntable of a centrifugal impact rock crushing machine for directing the aggregate radially outward from a central distribution cone to stationary anvils. The impeller shoe is elongated with a trapeziform shape. The impeller shoe has an inclined face working surface with an angle of between 10 and 12 degrees with respect to a back bearing surface. The shoe has inner and outer ends having inner and outer end surfaces respectively that extend transversely between the back bearing surface and the face surface. The inner and outer end surfaces are oriented at acute angles with respect to the back bearing surface. The inner end surface is oriented at an obtuse angle with respect to the face working surface. The outer end surface is preferably oriented at an acute angle with respect to the face working surface. A stepped notch is formed in the inner end complementary the contour of the central distribution cone to enable the inner end to engage and overlie the edge of the distribution cone to hold the cone in place.

6 Claims, 4 Drawing Figures

IMPELLER SHOE FOR CENTRIFUGAL IMPACT ROCK CRUSHING MACHINE

BACKGROUND OF THE INVENTION

This invention relates to centrifugal impact rock crushing machines and more particularly to impeller shoes for such machines.

In a centrifugal impact rock crushing machine, the rock is fed centrally onto a horizontal turntable that is rotating about a vertical shaft at a high speed. Impeller shoes are mounted on the turntable for causing the aggregate to accelerate radially outward from the central portion of the turntable to a very high velocity with the aggregate impacting against stationary wear-resistant anvil members to bring the aggregate to a sudden stop causing the deacceleration forces to break the rock along the crystalline planes of the aggregate.

One of the principal disadvantages of centrifugal impact rock crushing machines has been the extensive wear of the parts in the crushing chamber, particularly the impeller shoes. It is not unusual to have to replace the impeller shoes in less than forty-eight hours of operation.

One of the principal objects of this invention is to provide a unique impeller shoe that has a greatly increased wearability and longer life.

A further object of this invention is to provide a unique impeller shoe that increases the life of the impeller shoe in excess of 50% over prior art impeller shoes.

These and other objects and advantages of this invention will become apparent upon reading the following detailed description of a preferred embodiment.

BRIEF DESCRIPTION OF THE DRAWING

A preferred embodiment of this invention is illustrated in the accompanying drawing, in which.

DETAILED DESCRIPTION OF A PREFERRED EMBODIMENT

Figure 1:
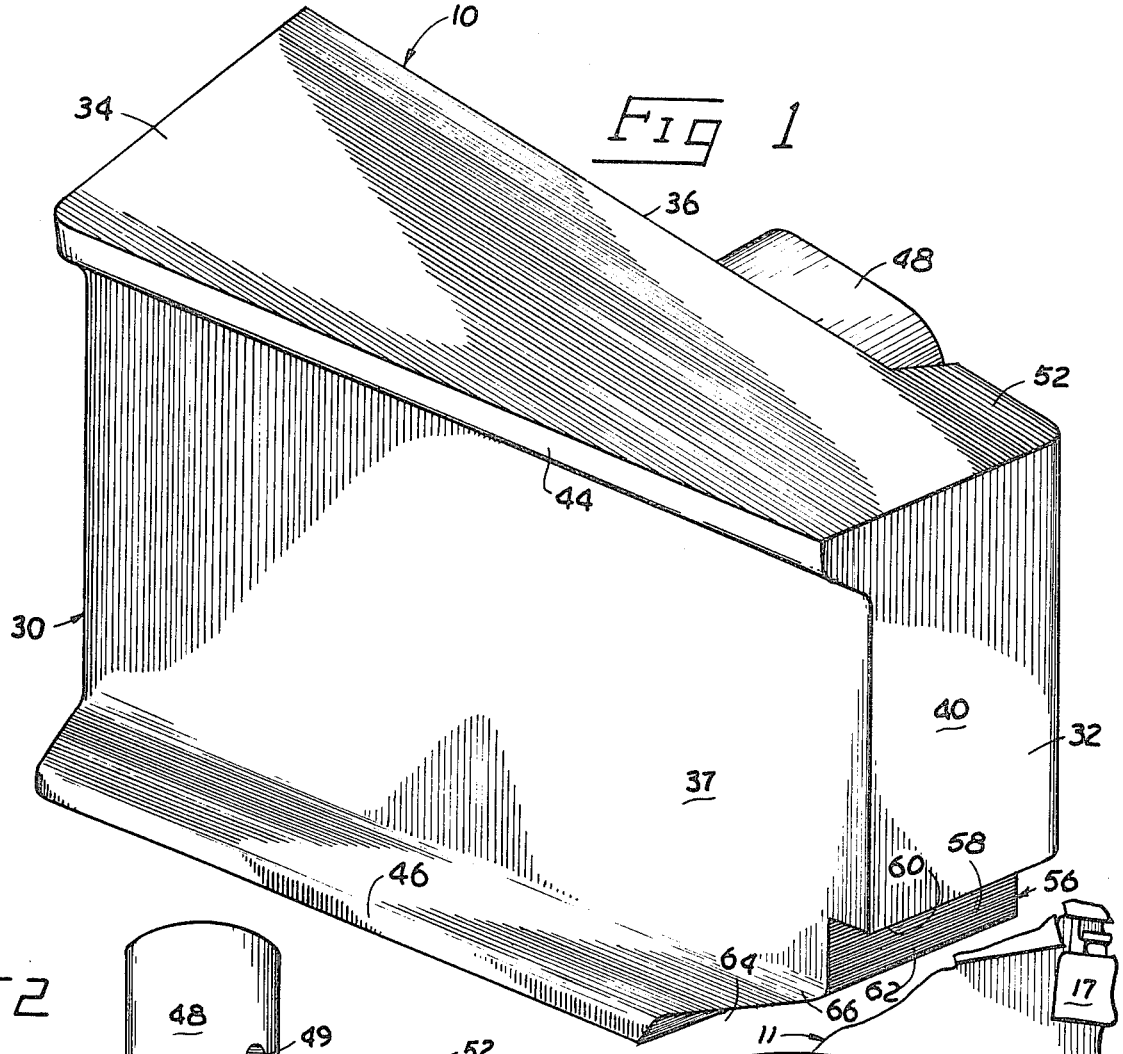
FIG. 1 is an isometric view of an impeller shoe which is the subject of this invention.
Figure 4:
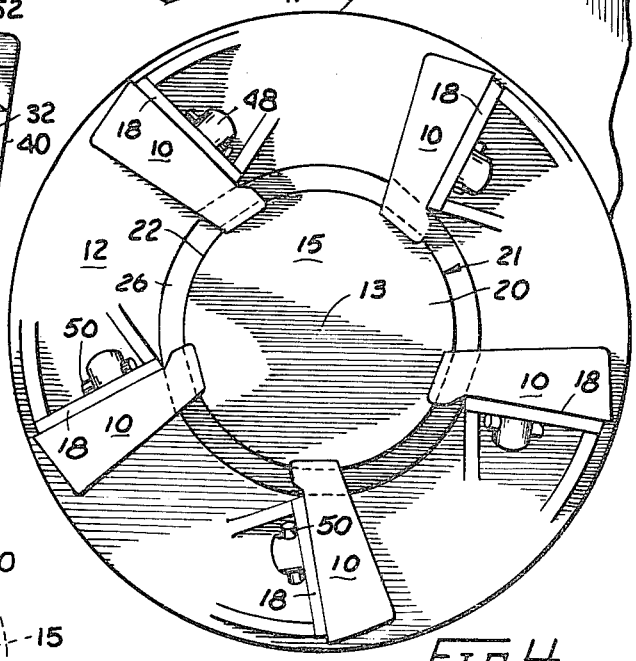
FIG. 4 is a fragmentary plan view of a crushing chamber of a centrifugal impact rock crushing machine showing the mounting of the impeller shoes on a turntable in the crushing chamber.

Referring now in detail to the drawing, there is illustrated in FIG. 1 an impeller shoe 10 for use in a vertical shaft centrifugal impact rock crushing machine designated with the numeral 11 in FIG. 4. An example of such a machine is illustrated in U.S. Pat. No. 3,606,182. Several of the impeller shoes 10 are mounted in radial orientations at angularly spaced locations on a turntable assembly 12. The turntable 12 is designed to rotate about a vertical axis 13. The turntable assembly 12 includes a central distribution cone 15 that is adapted to receive the aggregate from an overhead feed and to distribute the aggregate radially outward to the impeller shoes 10. As the turntable assembly 12 is rotated at a high speed the aggregate is accelerated radially outward along the impeller shoes 10 in a trajectory to impinge against the faces of stationary peripheral anvils 17. The impeller shoes 10 are securely mounted to the turntable 12 by shoe brackets 18.

The central distribution cone 15 is mounted coaxially with respect to the vertical axis 13 and has a flat top surface 20 that extends from the vertical axis radially outward to an annular peripheral surface 21. The flat top surface 20 and the annular peripheral surface 21 intersect at a top annular edge 22.

The annular peripheral surface 21 of the central distribution cone 15 includes a vertical annular section 24 that extends downwardly from the top edge 22. An inclined annular section 26 extends downward and outward from the vertical annular section 24 towards the turntable plate (not shown).

Figure 2:
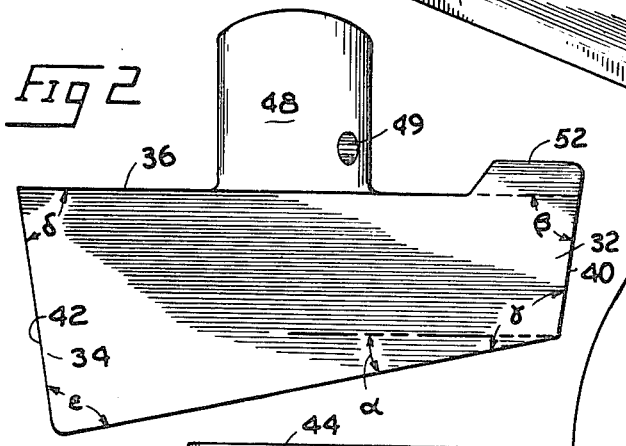
FIG. 2 is a plan view of the impeller shoe illustrated in FIG. 1.
Figure 3:
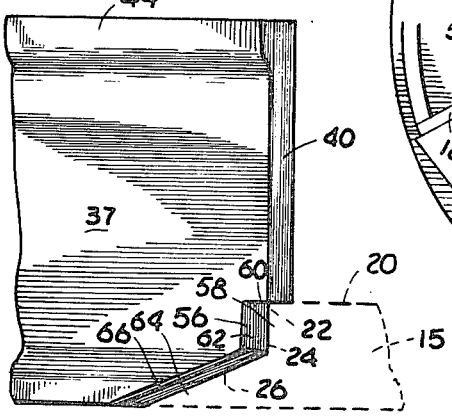
FIG. 3 is a fragmentary front view of the impeller shoe showing the shoe mounted in relation to the central distribution cone.

Each impeller shoe 10 is formed of an elongated body 30 composed of an abrasive resistant cast iron material of the general classification— ASTM A 532 Class III. The elongated body 30 extends radially outward from an inner end 32 to an outer end 34. The outer end 34, when mounted on the turntable, terminates substantially coincident with the outer perimeter of the turntable. The inner end 32 extends radially inward and over the peripheral surface 21 and a portion of the flat top surface 20 of the distribution cone 15. The elongated body is formed, when viewed in FIGS. 2 and 4, in a trapeziform shape having a back bearing surface 36 that extends longitudinally from the inner end 32 to the outer end 34. The body 30 further includes a face working surface 37 that extends from the inner end 32 to the outer end 34. The face working surface 37 is formed on an inclined angle $\alpha$ with respect to the back bearing surface 36 (FIG. 2). It is important to the performance of the impeller shoe that the face working surface 37 has an inclined angle $\alpha$ of between 10 and 12 degrees with respect to the back bearing surface 36. In a preferred embodiment angle $\alpha$ is 11 degrees.

The elongated body 30 further includes an inner surface 40 that extends transversely from the face working surface 37 to the back bearing surface 36. The inner end surface 40 is oriented at an acute angle $\beta$ of between 79–82 degrees with respect to the back surface 36. Preferably angle $\beta$ is 80 degrees. The inner end surface 40 is oriented at an obtuse angle $\gamma$ of 108 to 114 degrees. Preferably angle $\gamma$ is 111 degrees.

Also the body 30 includes an outer end surface 42 that extends transversely between the back bearing surface 36 and the face working surface 37. The outer end surface 42 is oriented at an acute angle $\delta$ of 80–83 degrees with respect to the back working surface 37. Preferably angle $\delta$ is 81 degrees. The outer end surface 42 is oriented at an acute angle $\epsilon$ of between 83 and 90 degrees with respect to the face working surface 37. Preferably angle $\epsilon$ is 88 degrees.

The face working surface 37 includes longitudinal upper and lower lip or channel flanges 44 and 46 respectively for guiding the aggregate along the face working surface 37 from the central distribution cone 15 to the periphery of the turntable assembly 12.

The elongated body 30 includes a stub 48 that extends outward from the back bearing surface 36 intermediate the inner end 32 and the outer end 34. The back bearing surface 36 is designed to bear against and be supported by a shoe bracket 18 with the stub 48 projecting through the bracket for rigid connection. The stub 48 includes a diagonal aperture 49 for receiving a removable pin 50. The impeller shoe 10 is easily removable by first removing the pin 50 and pulling the impeller shoe 10 away from the bracket 18.

The inner end 32 of the body 30 includes a wing portion 52 that extends outwardly from the back bearing surface 36 for protecting the bracket 18 from excessive wear.

The inner end 32 further includes a stepped notch 56 that is formed transversely therethrough. The notch 56 is shaped complementary to the top flat surface 20 and the annular peripheral surface 21 of the central distribution cone 15. The transverse notch 56 includes an upper first notch section 58 that is complementary to the flat top surface 20 and the vertical annular section 24 of the distribution cone 15. The first notch section 58 includes a horizontal surface 60 for engaging and resting on the flat top surface 20. The notch section 58 further includes a vertical surface 62 for bearing against the vertical annular section 24. The transverse notch 56 further includes a second notch section 64 that is complementary to the inclined annular section 26 and includes an incline surface 66 for bearing against the annular incline section 26. The inner ends 32 of impeller shoes 10 engage and hold down the central distribution cone 15 and maintain the distribution cone 15 positioned coaxially with respect to the vertical axis 13 of the turntable 12.

It should be noted that the transverse notch 56 intersects the face working surface 37 including the lower channel flange 46. It should be noted that the horizontal surface 60 is intermediate the upper and lower channel flanges 44 and 46 so that the flat top surface 20 directs the aggregate radially outward onto the face working surface 37 intermediate the upper and lower channel flanges 44 and 46. The horizontal surface 60 is positioned at a height more than one quarter of the total height of the impeller shoe 10 so as to cause the aggregate to flow onto the face working surface 37 intermediate the upper and lower channel flanges 44 and 46 even though the top flat surface 20 of the central distribution cone 15 may be worn.

It should be understood that the above described embodiment is simply illustrative of the principals of this invention and numerous other embodiments may be readily devised without deviating therefrom. Therefore, only the following claims are intended to define or limit this invention.

What is claimed is:

1. An elongated impeller shoe for mounting to a bracket on a horizontal turntable of a vertical axis centrifugal rock crushing machine to accelerate aggregate radially outward from a central distribution cone to impact against stationary anvils to thereby crush the aggregate, in which the central distribution cone has (1) a top surface for initially receiving the aggregate and directing the aggregate radially outward to the elongated impeller shoe, and (2) an annular peripheral surface that extends downward from the top surface toward the turntable, said elongated impeller shoe comprising:

an elongated body of wear resistant alloy material extending longitudinally from an inner end to an outer end;

said body being of a generally trapeziform shape having (1) a back bearing surface extending longitudinally between the inner end and the outer end and adapted for bearing against such a turntable bracket; (2) a face surface extending longitudinally between upper and lower longitudinal channel lips from the inner end to the outer end and adapted for receiving and directing aggregate therealong; (3) an outer end surface extending transversely between the face surface and to the back bracket mounting surface; and (4) an inner end surface extending transversely between the face surface and the back bearing surface;

said face surface being formed at an acute angle of between 10 and 12 degrees with respect to the back bearing surface and being formed at an obtuse angle with respect to the inner end surface;

said inner and outer end surfaces being formed at acute angles with respect to the back bearing surface;

said inner end having a transverse notch formed therein intersecting the inner end surface and the face surface including the lower channel lip that is complementary to such a top surface and such an annular peripheral surface of the central distribution cone to enable the inner end of the body to extend over such an annular peripheral surface with the inner end surface overlying a portion of such a top surface of the central distribution cone.

2. The elongated impeller shoe as defined in claim 1 wherein the outer end surface is formed at an acute angle with respect to the face surface.

3. The elongated impeller shoe as defined in claim 1 wherein the inner end includes a wing portion that extends outward from the back bracket mounting surface for protecting such a turntable bracket from excessive wear.

4. The elongated impeller shoe as defined in claim 1 wherein the outer end surface is formed at an acute angle of between 80° and 83° with respect to the back bearing surface.

5. The elongated impeller shoe as defined in claim 1 wherein such an annular peripheral surface includes a substantially vertical annular section extending downward from the top surface and an inclined annular section extending downward and radially outward from the vertical annular section and wherein the transverse notch in the inner end of the shoe body has (1) a first notch section complementary to such a top surface and to such a vertical section, and (2) an inclined second notch section complementary to such an inclined annular section for enabling the inner end of the shoe to fit onto such a central distribution cone with the inner end surface overlying a portion of such a top surface.

6. The elongated impeller shoe as defined in claim 1 wherein the notch in the inner end of the shoe extends above the lower lip so that the impeller shoe may be mounted on such a turntable with such a top surface of the distribution cone above the lower lip and the inner end of the impeller shoe projecting over such a top surface.

* * * * *